US006182592B1

(12) United States Patent
Molz

(10) Patent No.: US 6,182,592 B1
(45) Date of Patent: Feb. 6, 2001

(54) DOCKING APPARATUS

(76) Inventor: Herbert F. Molz, 1556 Cypress Dr., No. 14, Jupiter, FL (US) 33469

( * ) Notice: Under 35 U.S.C. 154(b), the term of this patent shall be extended for 0 days.

(21) Appl. No.: 09/429,556

(22) Filed: Oct. 28, 1999

(51) Int. Cl.[7] ..... B63B 21/00

(52) U.S. Cl. ..... 114/230.23; 114/230.2; 114/230.21

(58) Field of Search ..... 114/230.2–230.26, 114/243, 254; 254/323, 314, 361

(56) References Cited

U.S. PATENT DOCUMENTS 3,422,783 * 1/1969 Moulin ..... 114/230
3,613,625 * 10/1971 Halsingborg ..... 114/230
3,842,780 * 10/1974 Allens et al. ..... 114/230
3,851,613 * 12/1974 Armour ..... 114/230
3,965,841 * 6/1976 Croese ..... 114/230
4,697,537 * 10/1987 Smith ..... 114/230
5,522,582 * 6/1996 Dilks ..... 254/323
5,692,735 * 12/1997 Aho et al. ..... 254/323
5,819,679 * 10/1998 Bonate et al. ..... 114/230
6,019,058 * 2/2000 Salyer et al. ..... 114/230.2

* cited by examiner

*Primary Examiner*—S. Joseph Morano
*Assistant Examiner*—Andrew Wright
(74) *Attorney, Agent, or Firm*—McHale & Slavin

(57) ABSTRACT

A docking system for vessels employing at retractable docking line coupled to a rotatable spool. The rotatable spool is controlled by an operator of the vessel by a centralized hydraulic or electrical system. The retrieval systems allows for free wheeling line deployment and variable speed line retraction. Solenoid valves and relays are used to allow an operator to retrieve lines at various speeds allowing the vessel to be moved fore or aft for proper docking alignment. A weighted end cap allows for passing of the docking lines and further provides for sealing of the docking system when placed in a storage position.

20 Claims, 7 Drawing Sheets

DOCKING APPARATUS

FIELD OF THE INVENTION

This invention relates to the marine industry and, in particular, to an improved docking apparatus for marine vessels allowing control of docking lines from the bridge of the vessel. This patent improves upon U.S. Pat. No. 5,746,149, the contents of which are incorporated herein by reference.

BACKGROUND INFORMATION

Close quarter maneuvering of large yachts, such as between 40 and 120 feet, can be most difficult should conditions exist that may affect the movement or operation of a vessel. Most yachts have difficulty maneuvering in confined areas due to their size, shape, and limited visibility. Current hull designs emphasize interior accommodations causing larger widths which leaves minimal water displacement. This enhanced freeboard complicates maneuvering in confined areas wherein wind can cause movement of the vessel; also deeper draft vessels may be more affected by current. In any event, docking of a vessel worth millions of dollars can be extremely difficult and any improper movement may result in severe property damage.

This close quarter maneuvering is typically performed by an experienced captain. However, even an experienced captain could loose control of a yacht should the current or wind become unpredictable. Further, if an experienced captain is not available, the yacht is unuseable. In addition, some vessel manufacturers have eliminated the walkway along the side of the yacht requiring docking and mooring functions to be performed through an open window or require a crew member to traverse an edge of the boat that was not designated for walking. On sport fishing yachts, walkways may not include railing or handrails making it most dangerous for a crew member to stand on the bow of such a yacht and attempt to pull the yacht to the dock by use of dock lines. Elimination or reduction of a walkway may increase the living space of a cabin but requires a crew member to walk through the cabin or pilot house in order to reach the bow or stern of the boat. In larger yachts it is not uncommon to require an experienced crew member at the bow and stern of the vessel adding to the cost of vessel operation. The crew member must be trained in the docking operation, be able to coordinate with the captain should the captain need to rotate the vessel thus requiring the crew member to immediately cleat a line to prevent from being pulled overboard.

Close quarter maneuvering is required when a vessel is in the process of docking either for a temporary stay or when setting up for an extended stay. If the vessel is too difficult to handle, the owner may avoid use of the vessel for fear of having to maneuver the vessel in a confined area. This can quickly defeat the benefit of owning a larger vessel or limit the usage of a vessel. For instance, a seventy foot sport fishing yacht has a considerable distance between the bow and the stern and typically requires an experienced individual to be positioned at both locations in order to handle lines during the docking process. The captain of the boat may be located two stories above the deck with communication performed through the use of hailers. When the vessel is maneuvered along a pier for the purposes of docking the boat, the captain typically utilizes controls for operating the propulsion engines taking into account the current and wind in order to position the vessel against the pier. In a twin engine vessel, one engine may be placed in a forward position and the second in reverse causing either the bow or stern to approach the pier, reversing the procedure causes the vessel to "walk" to the pier. Experienced captains may rotate rudders and place one engine in forward while a second engine is operated in reverse causing a current to flow past the rudders causing the stern to move inward while the reversing engine causes the bow to rotate, allowing for a side slip maneuver. Alternatively a crew member may throw either a stern or bow line to a dock hand wherein the captain can use the line as a spring causing the opposite end of the vessel to rotate against the dock towards the pier for securement. Such vessels typically cost millions of dollars and require a high level of expertise to operate. Not only does this add to the cost of operation, many yacht owners do not care to have hired employees share their vacation but have no choice in view of the circumstances.

Some long range yachts, commonly referred to as trawlers, may employ a single engine coupled to a large propeller wherein the docking maneuver becomes even more difficult. These vessels are typically used by retired individuals who do not care to employ trained crew members and must develop docking skills or discontinue boating. Trawlers currently require either the bow or the stern be brought to the dock where a line is cleated and the rudder rotated allowing a propeller wash to rotate the vessel. While such maneuvers are possible, it is very difficult procedure to learn and requires rudder rotation every time the propeller direction is changed. In such a vessel it is not uncommon for the owner to install a bow thruster which is effectively a reversible motor placed through the bow of a vessel at a perpendicular angle to the propulsion screws. Bow thrusters are quite expensive and due to their location are susceptible to premature failure. Barnacle growth in salt water is not uncommon and, despite advancements in bottom paint the thrusters, can quickly become encrusted with marine growth making the use ineffective. In addition, the use of a bow thruster requires yet another level of experience as they are high speed low usage motors. Extended or improper operation of the bow thruster can cause motor failure, a potentially disastrous condition during a docking maneuver.

Similarly stern thrusters may be used wherein electric motors with propellers are placed on the outboard sections of a boat stern. These motors have the same type of failure problems as bow thrusters, and will also fail if used by an inexperienced individual. For instance, to the inexperienced a thruster operated for ten seconds, might appear to not move the vessel. However, once the vessel begins to move it can move very quickly and, if the operator provided too much thrust, the vessel may not be stopped in time before hitting the dock. Stoppage may require direct operation of the thrusters in the opposite direction and, as with the initial movement, it takes time for the thrusters to counter the movement. Hopefully the reverse movement occurs at a time to slow the momentum of the vessel before impacting of the dock.

Thrusters also require a least one hole to be drawn through the hull of a vessel which may cause a reduction in the speed of the vessel and alter the structural integrity of the hull. Stern thrusters may be bolted to the stern area and cause excess drag to an otherwise smooth flow of water past the hull.

Another problem with current docking procedures it that in many instances the docking lines used by a vessel are unnecessarily large and bulky. Typically, lines kept on a vessel are used to maintain the vessel in position while the vessel is docked. However, such lines are not necessary if the vessel is being docked temporarily such as when the vessel is stopped for food, fuel, or even overnight stay in a protected marina. The use of the heavy lines for a docking procedure adds to the crew burden when a crew member must be able to throw an end of the line to a dock hand during the close quarter maneuvering. Unfortunately yachts may use ¾ or larger lines that are of such weight that even a strong crew member may only be able to throw a line ten feet. If there is an offshore wind it would make throwing of a heavy dock line even more burdensome. In addition, whenever a line is exposed to the elements its may retain water. If a dock line is stored, a crew member would need to carry the line from one area of the boat to the other. On larger vessels, if there is no storage lockers on the bow of the vessel the crew member would have to carry the line through the cabin or along the walkway and, as previously mentioned, if the walkway is narrow it makes this maneuver even more dangerous.

The experience of a dock hand also becomes critical when securing a line to a pier. A crew member may throw a free end of the line to a waiting dock hand who must then secure the line to the dock. As the crew member is never assured of the experience of the dock hand, an enlarged loop is typically placed at the end of the line wherein the dock hand places the loop over a cleat or around a piling. The crew member then pulls the vessel towards the pier before securing the line to a cleat mounted on the vessel. If this is performed during a rain or heavy dew, the deck of the vessel may be slick and the crew member can again be placed in a dangerous position while attempting to pull the vessel to the pier. A vessel can easily weigh over twenty-five tons making the manual pull most difficult for those not accustomed to the maneuver. Should the dock hand be required to pull the vessel, it is most unpredictable.

Once the vessel has been placed alongside the pier the lines must then be adjusted to position the vessel in a proper position in respect to surrounding fixed objects. Typically the lines must be adjusted so as to allow for ease of entrance and exit to the vessel in an area that facilitates occupant safety. For instance, a number of vessels have steps leading out of the cockpit for use in ingress and egress of the vessel. The steps may be located next to a handrail. Should a piling be located directly in front of the exit area, exiting may be hampered and the crew members must secure appropriate spring lines in order to properly position the vessel in relation to the pier.

The cleating process is also important as a line to a cleat can become unwrapped allowing the vessel to drift. If the line improperly is not properly tied to the cleat, yet another dangerous situation can occur should the vessel have to clear the pier quickly. For example if one line is removed from a cleat and a second line was improperly tied, the failure of the second line may place the vessel in a precarious position. Should the vessel drift or be moved away from the pier, the pressure onto the improperly tied line may make it difficult if not impossible for removal of the vessel.

Thus what is lacking in the art is an improved docking apparatus and method thereof that allows operators of larger vessels, particularly those between forty and one hundred twenty feet, to facilitate docking and provide an ability to maneuver the vessel once docked.

SUMMARY OF THE INVENTION

The instant invention is an improved docking system comprising a combination of line retrieval devices located in strategic positions. Each line retrieval device includes a line holding spool capable of freewheeling. Freewheeling allows a vessel passenger to assist in a docking maneuver by simply tossing a free end of the line to a dock hand, wherein the operator of the vessel may manipulate secured lines for purposes of docking the vessel. For instance, when a vessel is to be laid port side along a pier, securing lines from the line retrieval devices allows the operator of the vessel to control retraction of the line, and thus drawing of the vessel to the pier.

The line retrieval device of the instant invention may be based on hydraulic actuated motors actuated by a single pressure pump that is coupled to multiple line retrieval devices by a manifold. The hydraulic motors may be independently or simultaneously actuated. The motors can be controlled by a single bridge location control system, a remote control station, or from multiple stations.

A remote control station would allow the operator of the vessel to move a single controller mechanism to positions most advantageous for viewing operation of the line retrieval devices.

Multiple stations are made possible by placement of a receptacle on the port and starboard sidewall wherein the operator can attach a controller to the appropriate receptacle. Placement of the multiple station allows the operator to be in the most strategic position for docking.

The line retrieval devices include a freewheeling spool for quick line deployment and variable speed line retractions. The operator of the vessel is able to draw one line faster than the other thereby allowing the vessel to be moved fore or aft to assure proper alignment as well as maintain proper clearance between the vessel and other objects located in front or behind the vessel.

An advantage of the system allows the line size used for docking to be smaller than the line used for securing a vessel for an extended stay. The smaller line allows for compactness of the line retrieval device but more importantly allows any individual to assist in docking without having previous training.

For instance, on a seventy eight foot Hatteras yacht, the first experimental installation of the instant invention, employs a 7/16th inch line for use in the line retrieval device. Upon the operators command, an individual removes a free end of the line from the line retrieval device. The free end includes a weighted end cap, which operates as a monkey fist, and allows a controlled toss of the line to a dock hand. The weighted end, which consists of a rubber or the like grommet that also operates to seal the line retrieval spool from exposure to the elements, allows an individual to throw the line like a baseball or swing it should a farther distance be required. Once the line is thrown to a dock hand, the dock hand can simply place the free end around a cleat or piling. The operator may simply use a single line and, with the line retrieval operating controller, pull the bow of the boat inward by use of the engines. Similarly a passenger may throw a stern line wherein the operator of the vessel may draw the bow and stern of the vessel to the dock without further assistance of the vessel engines.

The improved docking apparatus includes a spring loaded line centering positioner operatively associated with a smooth spool. The smooth spool allows a loose line to become taunt under pressure, with the bitter end of the line coupled to the spool by a through hole that allows the entire length of line to be employed. A cylinder rod is used to engage the spool and prevent rotation of the spool upon release of motor actuation pressure.

The line retrieval devices may be placed on the bulwark, behind a weather board, on the cap rail, as substitution of a cleat, or installed as part of the sidewall, and so forth. The sidewalls of the vessel may include an opening for a line leading into a spool holder incorporated during construction or mounted in a retrofit with minimal sidewall reinforcement. The monkey-fist or weighted end cover that attaches to the free end of the line further operates as a seal to block water from entering the line retrieval device when the line is not in use. End covers are preferably constructed of a rubber that does not mar fiberglass or paint should it impact the vessel during deployment or retraction. The end cover operates as a weight as previously described which further allows the operator of the vessel to maintain a distance from the pier and draw the vessel to the pier only when the operator has full control of the vessel through the line retrieval devices.

Thus, an objective of the instant invention is to provide an improved docking apparatus that allows the operator of the vessel to control the docking maneuvers from the bridge or a remote location.

Another objective of the instant invention is to teach the use of a docking apparatus that allows the use smaller lines for purposes of docking maneuvers wherein such lines can be longer and less difficult to handle than conventional docking lines, and be of a weight allowing for ease of throwing or compact storage thereof.

Another objective of the instant invention is to disclose an improved docking apparatus that lessens the need for trained crew members during docking maneuvers.

Yet another objective of the instant invention is to disclose a docking apparatus that replaces conventional line handling techniques by use of a line retrieval device allowing the operator of the vessel to maneuver the vessel into position without requiring any crew or passengers member to assist in movement of the vessel.

Another objective of the instant invention is to disclose the use of a dock handling device that conceals and seals a docking line upon retrieval.

Still another objective is to disclose a docking apparatus that allows for variable speed control of docking lines by both permitting freewheeling of the line spool upon deployment and variable speed upon retraction.

Yet still another objective of the instant invention is disclose a docking apparatus that can be used in combination with a bolt cleat.

Another objective of the instant invention is to disclose the use of a smooth spool which allows a loose line to become tight upon retraction wherein a smooth spool allows the line to wrap tightly around the smooth spool without adhering thereto.

Still another objective of the instant invention is to disclose the use of bronze bearings and thrust washers for the spool to reduce corrosion and eliminate all bearing failure.

Yet another objective of the instant invention is to disclose the use of a cylinder rod which operates in conjunction with a hydraulic motor for engaging a slotted in the spool to prevent rotation when hydraulic pressure is withdrawn.

Yet still another objective of the instant invention is to disclose the use of self centering device employing dual springs wherein a first spring of predetermined compression maintains the line in a self spooling format wherein the line allowed to follow the natural roll upon retraction and a second higher compression spring prevents binding of the line against the sidewall of the spool.

Other objectives and advantages of this invention will become apparent from the following description taken in conjunction with the accompanying drawing wherein are set forth, by way of illustration and example, certain embodiments of this invention. The drawings constitute a part of the specification and include exemplary embodiments of the present invention and illustrate various objectives and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
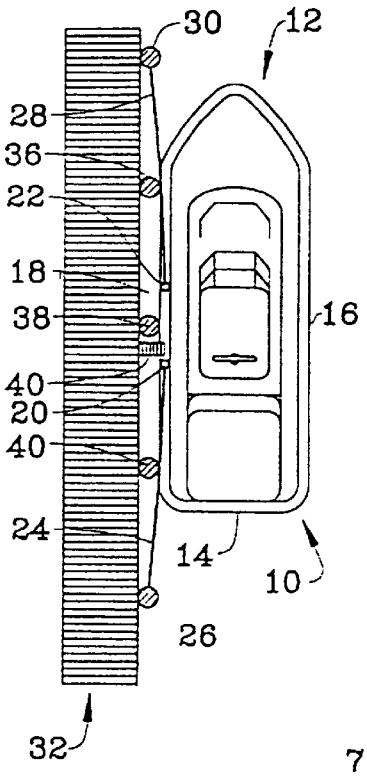
FIG. 1 is a pictorial view of the docking apparatus of the instant invention placed along a port side position fore and aft of a vessel.

Now referring to FIG. 1, vessel 10 is illustrated and defined by a bow 12, stern 14, starboard side 16 and port side 18. The vessel 10 illustrates the place of a first embodiment of the docking apparatus of the instant invention wherein line retrievable device 20 is positioned on the aft section of the port side 18 of the vessel with a second line retrieval device 22 located on the forward portion of the port side 18, to be described in more detail later in this specification.

The line retrieval device 20 utilizes line 24 having a proximal end coupled to a spool placed within a housing structure with a distal end that is readily removed from the housing structure upon release of the spool. The line 24 is placed over pile 26 and is then available to be drawn into the housing as necessary. The line 24 includes a predefined loop on the distal end of the line allowing for easy attachment to pile 26 or a pier mounted cleat. Similarly line retrieval device 22 employs line 28 having a proximal end secured to a spool within the housing structure of the device. The distal end of the line 28 also includes a predefined loop which is available for placement around pile 30. The spools are preferably hydraulic powered allowing free wheeling deployment upon release of the hydraulic fluid.

Once the lines are placed around the pile, the operator or "captain" of the vessel 10 may then engage the line retrieval devices 20 and 22 causing retrieval of the lines 28 and 24 to draw the vessel 10 along side pier 32. The ability to control the speed and operation of each line retrieval device will allow the operator to position the vessel in the most appropriate position for ease of entering and exiting of the vessel. For instance, pier 32 includes pilings 36, 38 and 40 shown along the port side of the vessel. The operator has positioned the vessel 10 to position pilings 36 and 40 for support of the vessel. The positioning against pile 38 further allows for placement of entrance ladder 40 for safely coupling the walkway of the vessel to the pier.

Line retrieval device 20 allows the operator to move the vessel rearward while line retrieval device 22 allows movement of the vessel forward. The apparatus allows for instant adjustment of the lines should a tidal change occur the need for minute adjustment exist. This eliminates the need for an individual to manually adjust the line and keeps the individual out of the elements such as rain. Once the vessel is docked, the vessel can then be fueled, boarded or otherwise serviced without the need for additional lines. If the docking is extended, the vessel is in proper position to be tendered to the pier in a more permanent attachment through use of mooring lines. This procedure is simplified by placement of the vessel in the preferred docking position before the use of heavy mooring lines. It should be noted that the line retrieval devices may be located on the starboard side in place of, or in addition to, the port side placement. It is further noted that the majority of the vessels dictate entrance and exit along the starboard side and the figure is for purposes of illustration only.

Figure 2:
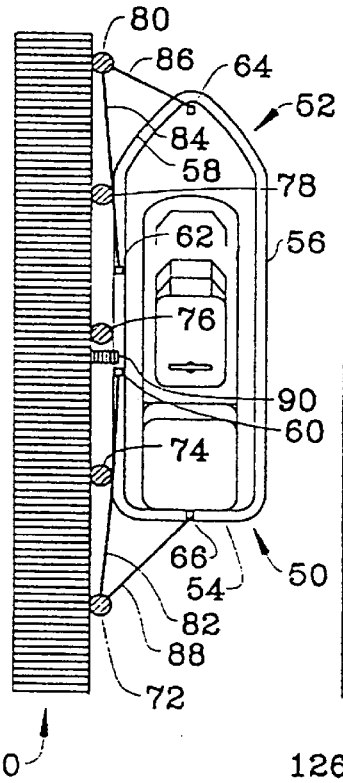
FIG. 2 is a pictorial view of the docking apparatus placed in a fore and aft port position as well as locations at the bow and stern of the vessel.

Referring now to FIG. 2, illustrated is vessel 50 defined by bow section 52, stern 54, starboard side 56, and port side 58. In this embodiment a line retrieval device 60 is located on the aft section of the port side 58 with line retrieval device 62 located on the forward portion of the port side 58. The line retrieval devices may be positioned adjacent to a cleat or be used as a replacement thereto. As will be shown later in this specification, when the line retrieval device is used as a replacement cleat, the cleat is integrated into the line retrieval structure eliminating the need for additional deck space. This embodiment further includes a line retrieval apparatus 64 located on the bow of the vessel and a stern line retrieval device 66 centrally disposed along the stern section 54 of the vessel. The addition of the bow and stern line retrieval devices allow for the temporary docking of the vessel in higher winds and current. The additional lines allow the docking of the vessel for temporary periods where the heavier mooring lines are not required. For instance, if the vessel is left unattended while the occupants are in a restaurant, the need for additional lines is unnecessary.

In this embodiment, the vessel 50 is pulled along side pier 70 having pilings 72, 74, 76, 78 and 80. Line retrieval apparatus 60 employs a light line 82 for securement to pile 72 providing a spring line operation and allowing the operator to again position the vessel in the appropriate location in relation to pile 74. The forward spring line retrieval apparatus 62 employs line 84 for placement around pile 80 providing the operator with the ability to pull the vessel forward as necessary. The retrieval apparatus 64 employs line 86 for securement to pile 80 and line retrieve apparatus 66 employs line 88 for coupling to pile 72. The lines maintain the bow and stern in the appropriate position against pier 70. The walkway 90 may then be properly positioned for placement along side pile 76 for use and entrance and exiting of the vessel. Unique to these embodiments is the ability of the docking apparatus to employ light lines for purposes of docking. This allows for compact spool housings and ease of line handling.

Figure 3:
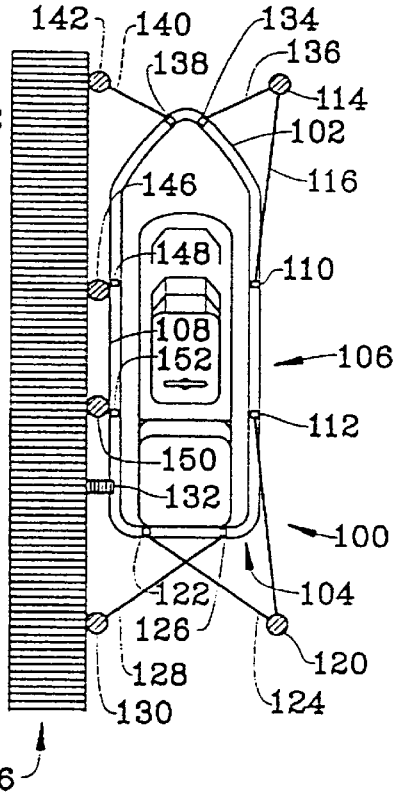
FIG. 3 illustrates the docking apparatus located at each of the key locations of the vessel.

Referring now to FIG. 3 set forth is yet another embodiment of the instant invention utilizing multiple positions on a vessel for support. In this embodiment, vessel 100 is defined by a bow 102, stern 104, starboard side 106 and port side 108. Line retrieval devices are located along the starboard side 106 as depicted by numerals 110 and 112, the port side as depicted by numerals 148 and 150, the bow 102 as depicted by numerals 134 and 138, and the stern 104 as depicted by numerals 122 and 126.

In this embodiment, the vessel 100 is secured to pile 114 by attachment of line 116 spooled by the line retrieval device 110. The line retrieval device 110 is then operated as a spring line attachment to prevent rearward movement of the vessel during tidal change, wind or current movement. Similarly line retrieval apparatus 112 employs line 118 for attachment to pile 120 to prevent forward movement of the vessel, line 118 operating as an aft spring line. The stern 104 of the vessel includes a port side stern line retrieval apparatus 122 wherein line 124 crosses the center of the stern of the vessel for attachment to pile 120. Line 124 prevents the stern of the vessel from impacting the pier 126 making the arrangement suitable for higher winds without the need for additional morning lines. The stern mounted starboard side line retrieval apparatus 126 employs line 128 for attachment to pile 130. Line 128 operates to prevent the vessel from movement away from the pier thereby maintaining the walkway 132 in a fixed position for ease of entrance and exiting of the cockpit from the vessel. On the bow of the vessel a starboard line retrieval device 134 employs line 136 for attachment pile 114 preventing the bow of the vessel from impacting pier. Similarly the port side line retrieval device 138 on the bow 102 employs line 140 for attachment to pile 142. This line attachment prevents the vessel from an outward movement just to maintain a close proximity to the pier 126.

In this example, piles 130 and 142 are used for docking lines, however, no piles are available for positioning the vessel apart from the pier. For this reason, the vessel is spaced from the pier by the use of fenders 146 and 150 which provide a cushion from the pier 126. Fenders are commonly found on the vessel so as to accommodate oversized piles or lack thereof. In this illustration a fender 146 is attached to the line retrieval device 148 wherein the operator can deploy or retrieve line as necessary so as to position the fender 146 in a proper location. Similarly fender 150 is attached to line retrieval device 152 allowing the operator to change fender location from the bridge. In this manner as the vessel 100 is brought along side the pier 126 wherein the operator is able to instantly adjust the positioning of the fenders should in an impact with the pier be inevitable thereby protecting the finish of the vessel. It is noted that the docking apparatus is not specifically designed as a fender holder, it operates only as an ancillary benefit to further allow the vessel operator to maneuver the vessel in close quarters with minimal crew members.

Figure 4:
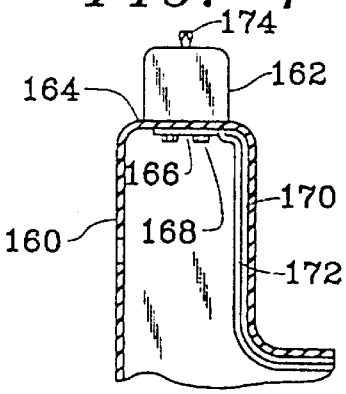
FIG. 4 is a cross-sectional side view of a bulwark showing the instant invention mounted along the top portion of the bulwark.
Figure 5:
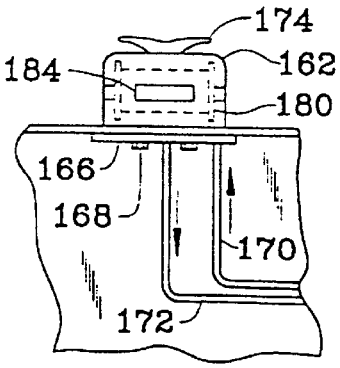
FIG. 5 is a front view of FIG. 4.
Figure 6:
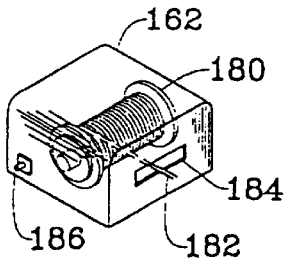
FIG. 6 is a perspective view of the line retrieval device for the docking apparatus.

Now referring to FIG. 4, shown is a bulwark 160 having line retrieval device 162 positioned along an upper surface 164. The line retrieval device 162 is an individually housed winch that is actuated by a central pump and valve manifold. The winch is bi-directional and free wheeling employing a motor allowing variable speed and power. The line retrieval device 162 is secured to the bulwark 164 by placement of a reinforcement plate 166 beneath bulwark to distribute the load with mounting bolts 168 maintaining the line retrieval device 162 in a secure position. The hydraulic fluid of the instant invention is run through piping system 170 as a pressurized feed and 172 return flow line, or in the reverse direction which is dependant upon the placement of the directional solenoid valves.

The tubing maybe metal or preferably hydraulic hose that is in impervious to salt water corrosion. A cleat 174 is located on the upper wall of the line retrieval device wherein the line structure is of a sufficient rigidity to withstand cleat attachment with the same strength had the cleat been secured directly to the vessel.

A spool 180 is positioned inside the structure which allows for line 182 movement through aperture 184 as needed. The line includes a sealing end cap formed as a monkey fist, as described later in this specification, which is operatively associated with the aperture to prevent the elements from entering the structure while the line is in a storage position. Drainage of the line retrieval structure is possible through apertures located along a bottom surface, not shown, allowing drainage and ventilation for drying. A remote actuator 186 allows for micro adjustment of the line 182 directly from the line retrieval device 162 so as to allow the operator of the vessel to make minute line adjustments without the need for returning to the centralized control panel to be mounted on the bridge.

The preferred speed for a winch is thirty feet per minute (30 fpm) with approximately one thousand pounds of tension. The winch housing mount is rated for five thousand pounds and hold at least twenty five feet of docking line. Each winch includes a limiting switch to disengage the winch once the line is fully retrieved.

Figure 7:
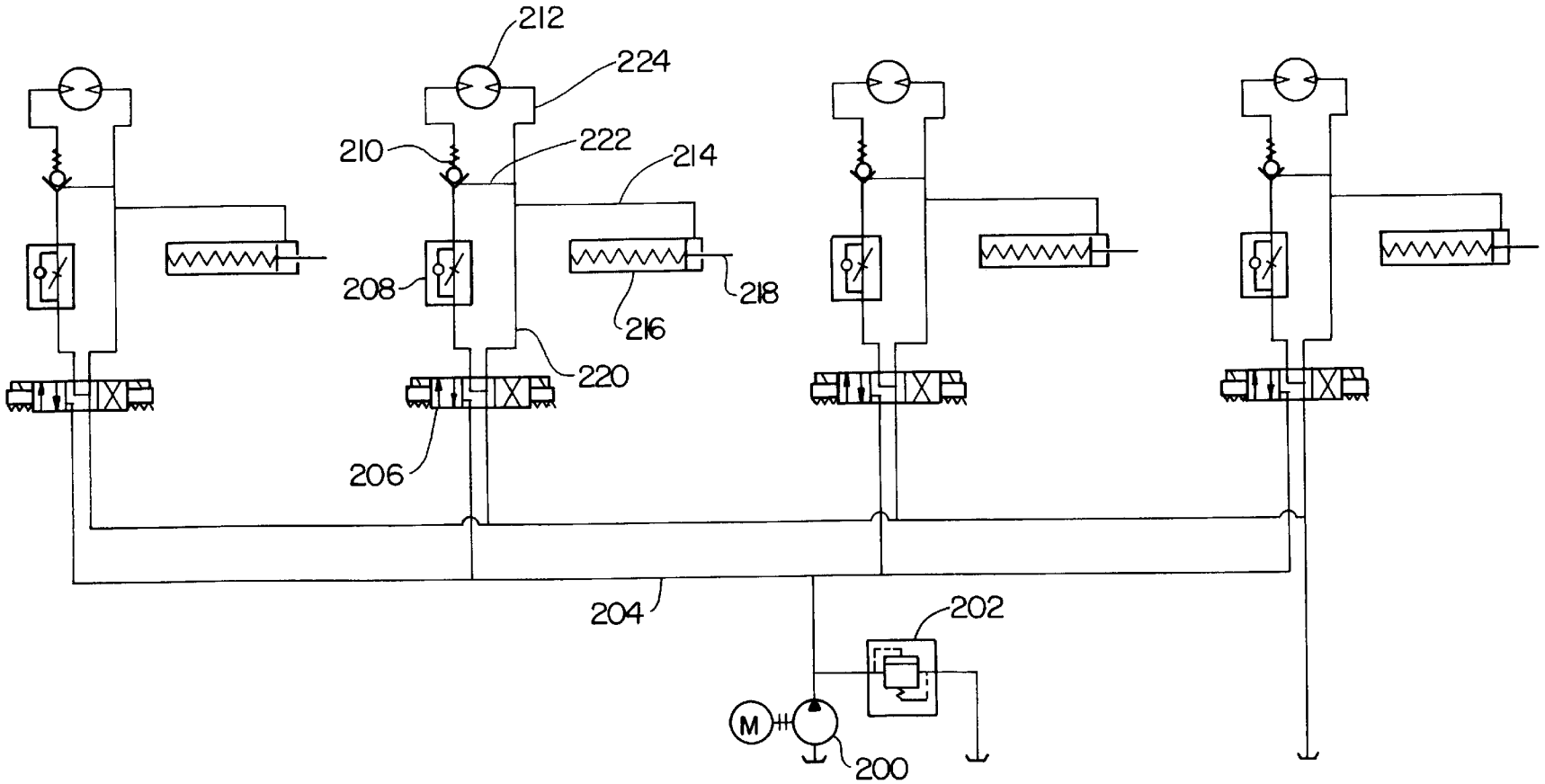
FIG. 7 is a hydraulic schematic for control of the docking apparatus.

Now referring to FIG. 7, set forth is a hydraulic schematic of the preferred embodiment illustrating a hydraulic pump 200 drawing fluid from reservoir 202. It is noted that the pressure line is illustrated coupled to four hydraulic motors, however, the number of hydraulic motors is dependant upon the preference of installation and may consist of one or more motors. For clarity, only a single motor is numerically illustrated. The pressure line 204 delivers fluid through a hydraulic switching valve 206 allowing for clockwise and counterclockwise rotation of the hydraulic motor 212. Upon engaging flow control 208 delivers, pressured fluid is directed through check valve 210 for clockwise rotation of hydraulic motor 212. Pressurized hydraulic fluid is also delivered through conduit line 214 to hydraulic release cylinder 216 which causes a retraction of cylinder rod 218 from a spring loaded engagement with line holding spool, shown in FIGS. 9 and 9A, coupled to motor 212. The retraction of cylinder rod 218 allows motor 212 to rotate, according to the direction of the fluid for purposes of spool rotation. Upon placing valve 206 in Neutral position spring loaded check valve 210 closes motor 212 is discontinued. Cylinder rod 216, also spring loaded, releases rod 218 allowing projection outward to engage and lock the spool in a limited rotation position. The cylinder rod 218 prevents rotation of the spool by positive lock.

Rotation of the hydraulic motor in a counterclockwise movement employs hydraulic switching valve 206 to divert fluid through conduit 220 for engaging of the hydraulic release cylinder 216 for retraction of cylinder rod 218. Fluid is also delivered through coupling line 222 for purposes of lifting check valve 210 and to the hydraulic motor 266 through the outlet port as designated when operated in a clockwise rotation.

Figure 8:
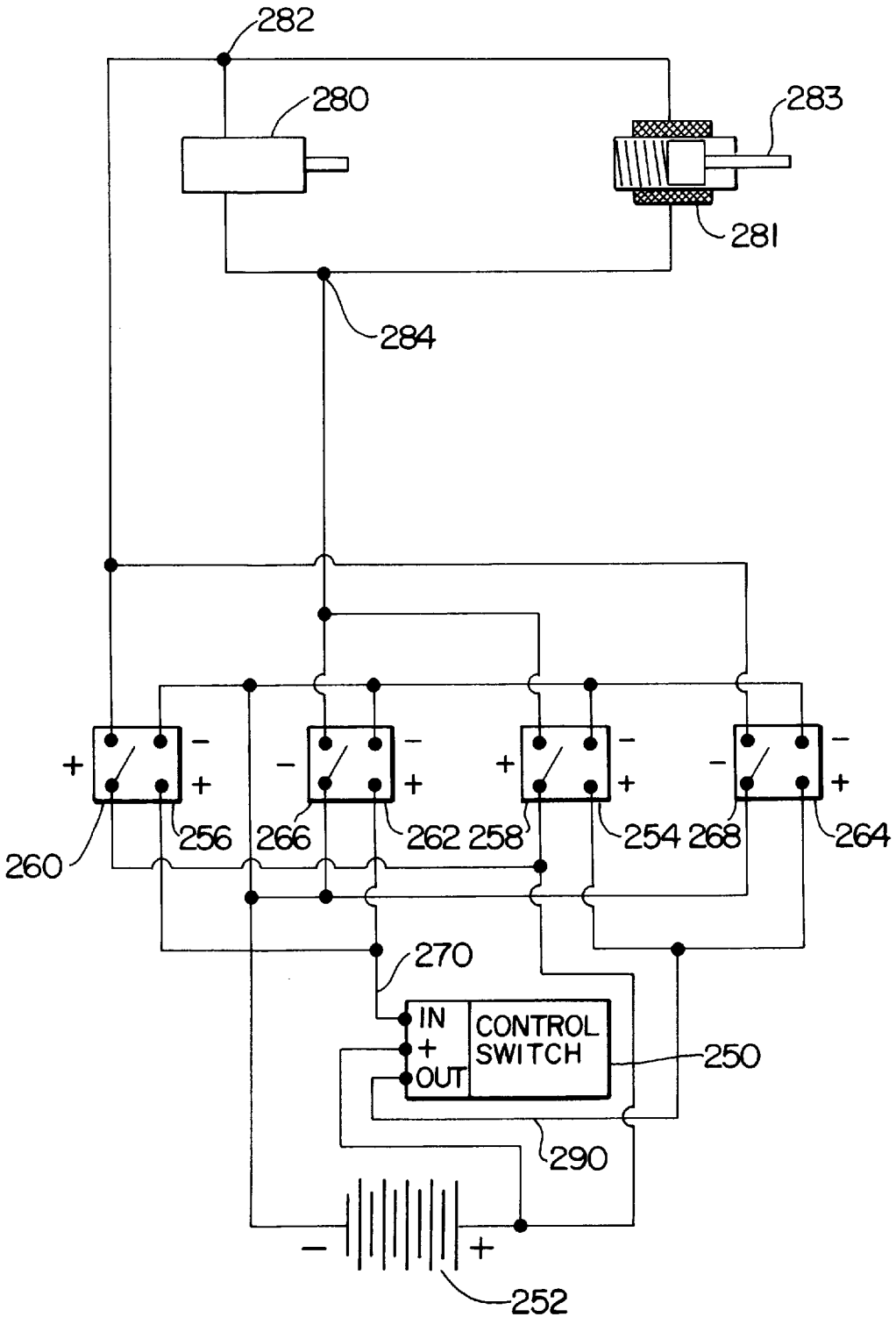
FIG. 8 is an electrical schematic of control of the docking apparatus.

Referring to FIG. 8 an electrical embodiment of the instant invention is illustrated wherein relays provide the same control action as the hydraulic solenoids allowing operation of electric motors versus hydraulic motors in instances where an electrical embodiment is preferred or otherwise warranted. In this embodiment control switch 250 is coupled to the positive output of a battery source 252 through relays 254 and 256 providing voltage to contact points 258 and 260. It is noted that the negative side of the battery source 252 is electrically coupled to relay 262 and 264 through contact points 266 and 268. Upon closure of the relays, positive voltage is provided through control switch 250 through coupling line 270 to activate relay 256 and 262, relay 256 thereby allowing positive voltage to motor 280, contact 266 and relay 262 provides negative voltage to motor 280. As with the previous embodiment, multiple electric motors may be employed in a parallel configuration. For reversing of the motor, control switch 250 is coupled to output line 290 providing positive voltage to solenoids 254 and 264, causing the solenoids to activate wherein solenoid 254 provides positive voltage to electric motor 280 at contact switch 284, relay 264 provides negative voltage to motor 280 through contact switch 282. In this manner relays provide control of the positive and negative voltage to the motor with an absolute disconnect by the control switch allowing reversal of the DC motor by reversing of polarity. As with the hydraulic embodiment, a spring loaded solenoid 281 provides a locking cylinder rod 283 to engage the spool as further illustrated in FIG. 9A. This allows a positive lock in a similar manner to the hydraulic cylinder lock. The cylinder rod provides a direct and positive lock to the spool.

Figures 9, 9A:
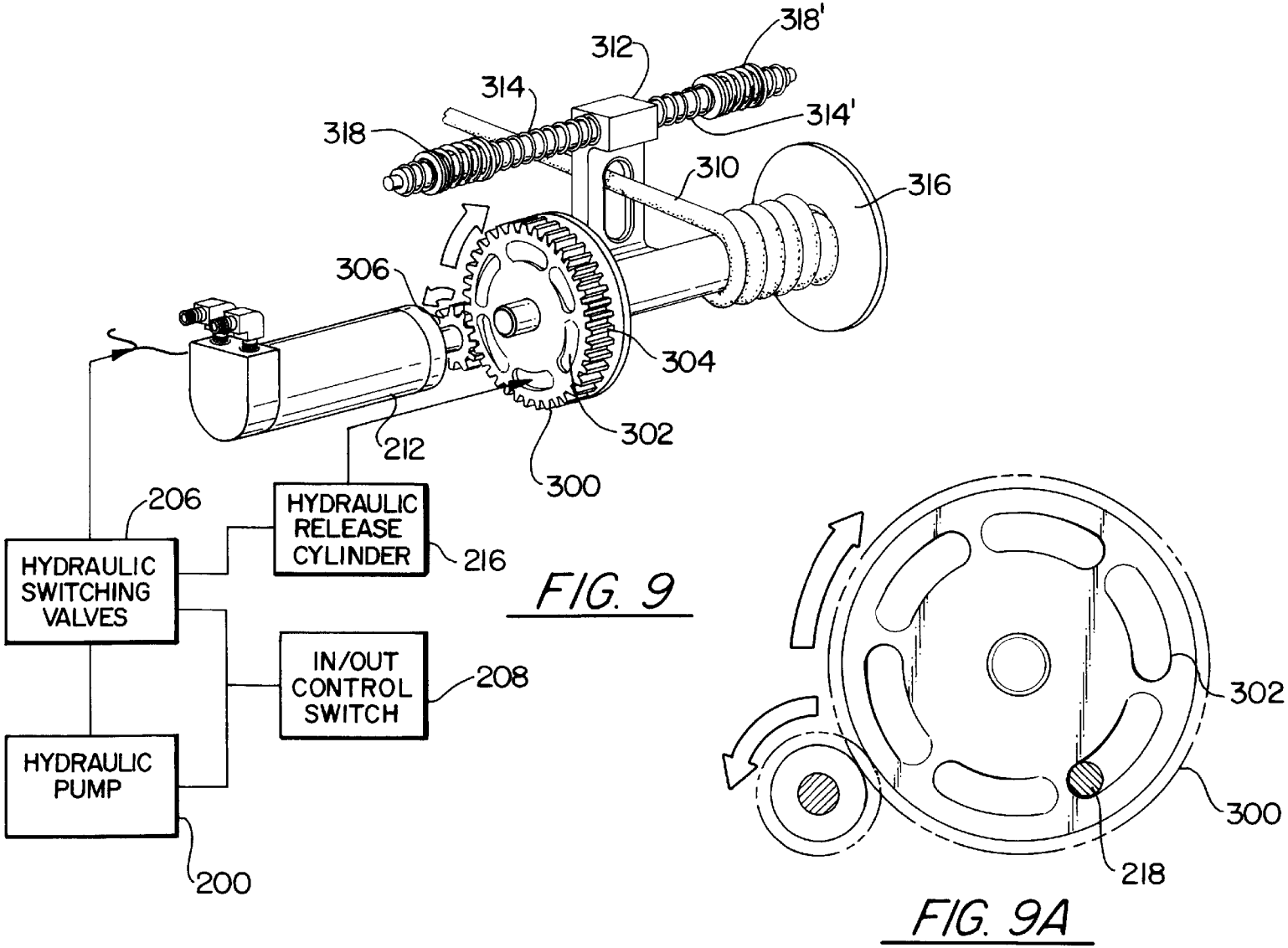
FIG. 9 is a pictorial of the line retrieval device including the hydraulic motor, spool, and line positioner.
FIG. 9A is a pictorial end view of the spool with cylinder lock.

Now referring in general to FIG. 9 and 9A, set forth is a pictorial of the hydraulic embodiment. In particular, hydraulic motor 212 is illustrated with hydraulic switching valves 206 shown in a pictorial coupled to hydraulic pump 200 and the in/out control switch 208. The hydraulic release cylinder 216 is used to engage spool 300 having apertures 302 for receipt of the locking cylinder rod 218. In this embodiment hydraulic motor 212 rotates the spool 300 by use of gear mechanism 304 operatively associated with gear reduction spindle 306 located on the end of hydraulic motor 212. The spool includes spindle 308 for spooling of line 310 and retraction or projection of the line during the docking procedure. Also illustrated is line alignment device 312 which works in conjunction with the natural tendency of line 310 to spool around spool cylinder 308 by use of primary springs 314' with sidewall 316 line engagement made possible by secondary springs 318 and 318'.

Figure 10:
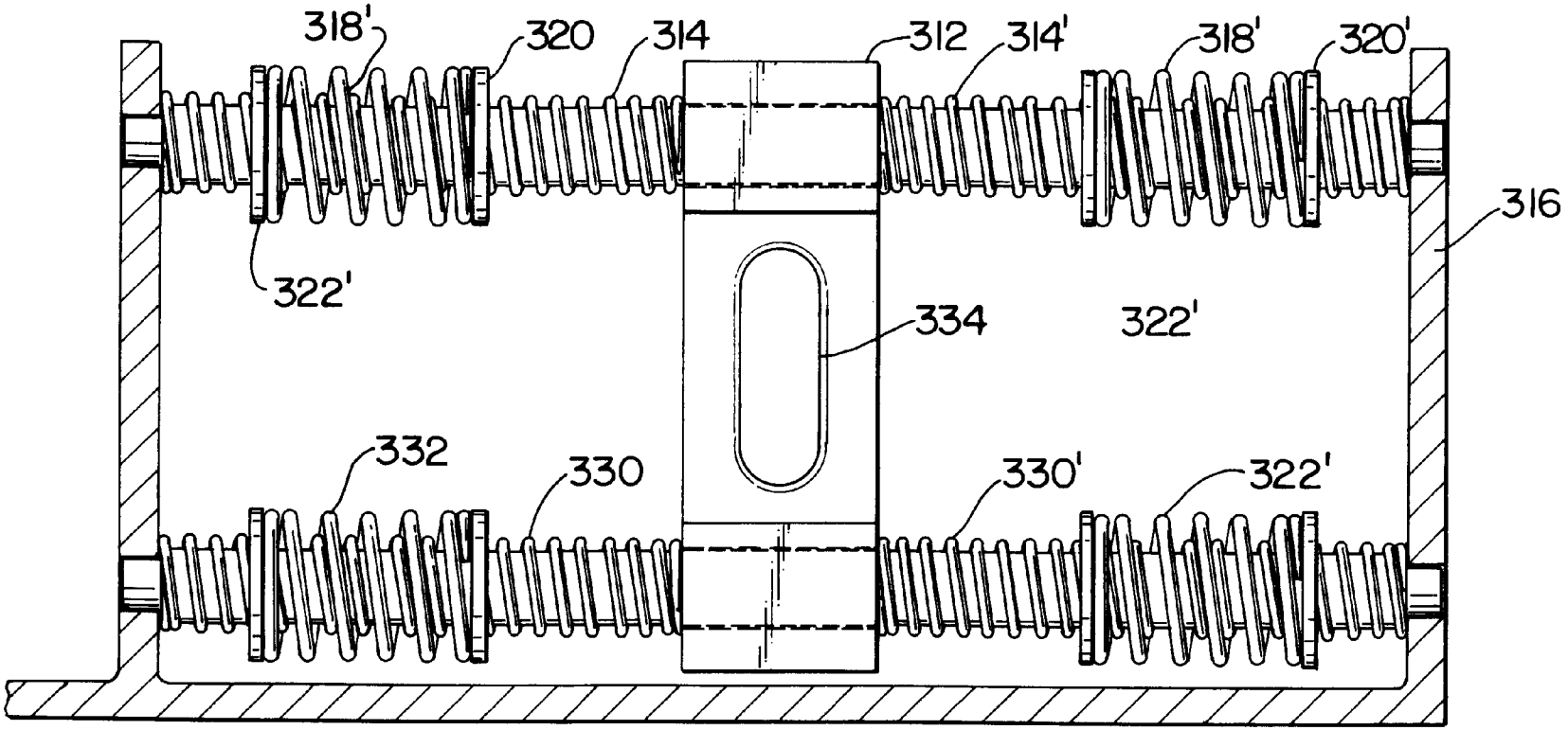
FIG. 10 is a plain view of the line positioner.

Referring to FIG. 10, the line alignment mechanism is further illustrated with primary springs 314 and 314' located on either side of the line alignment device 312 over support rods with secondary springs 318 and 318' placed over the primary springs 314 and 314' in a unsecured floating manner. Secondary springs include non-friction washers 320 and 322 located on each end of the secondary spring allowing the spring to engage sidewall 316 as well as the alignment device 312 without binding. The primary springs having a first biasing strength, less than the secondary springs having a second biasing strength. Lower portion of alignment 312 further includes primary springs 330 and 330' together with secondary springs 332 and 332' maintaining a vertical position of the alignment device 312 allowing a predetermined line size to fit through oblong aperture 334 for coupling to the spool.

Figure 11:
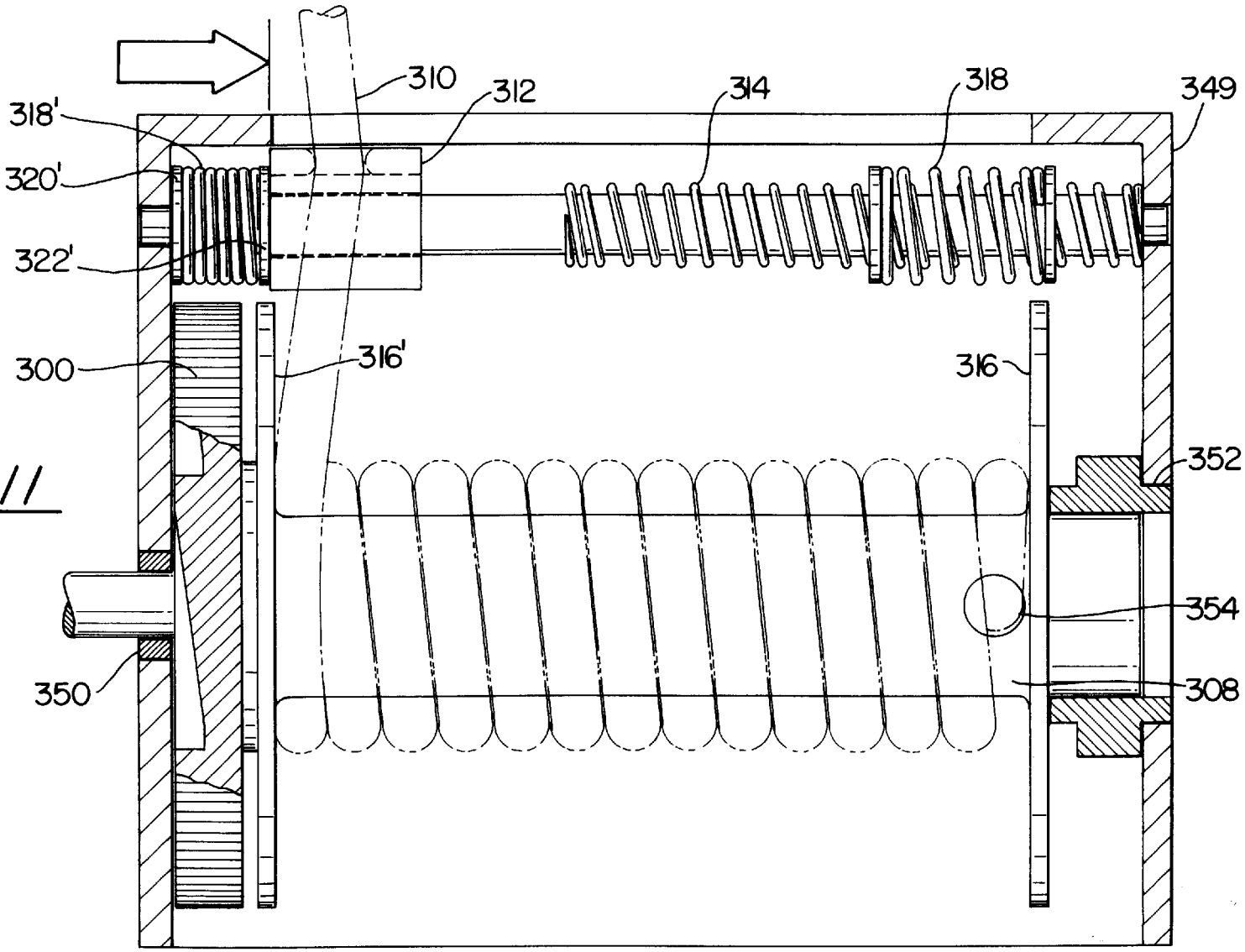
FIG. 11 is top view of the line positioner and spool having a single line wrap.

FIG. 11 illustrates spool 300 and integral spool spindle 308 with line 310 pulled through line alignment device 312. Primary spring 314 is shown with secondary spring 318 in a relaxed position as the line 310 had followed a natural curvature around the spindle 308 forcing primary 314 and secondary springs 318' directly against spindle 300. Alignment washers 320' and 322' inhibit engagement of the line alignment device 312 from reaching a sidewall of the housing 349, and as illustrated by the curvature of the line 310, prevents the line from being pinched against sidewall 316'. As noted by the illustration of the line, a natural roll back to the opposite spool wall 316 is provided by the combination. In addition, spool spindle 308 is mounted on bronze bearings 350 and 352 which eliminates corrosion of ball bearings and further operates as a thrust washer to inhibit horizontal movement caused by line tightening.

Spindle 308 has a finished surface wherein line 310, when wrapped without pressure, will follow a nature wrap and become taught upon the application of pressure to the line. In addition through-hole 354 is provided for placement of the bitter end of the line which allows securement by a simple knot, not shown, placed inside the spindle to prevent loss of line should the spool be over rotated and the line begin to wrap backwards over the spindle.

Figure 12:
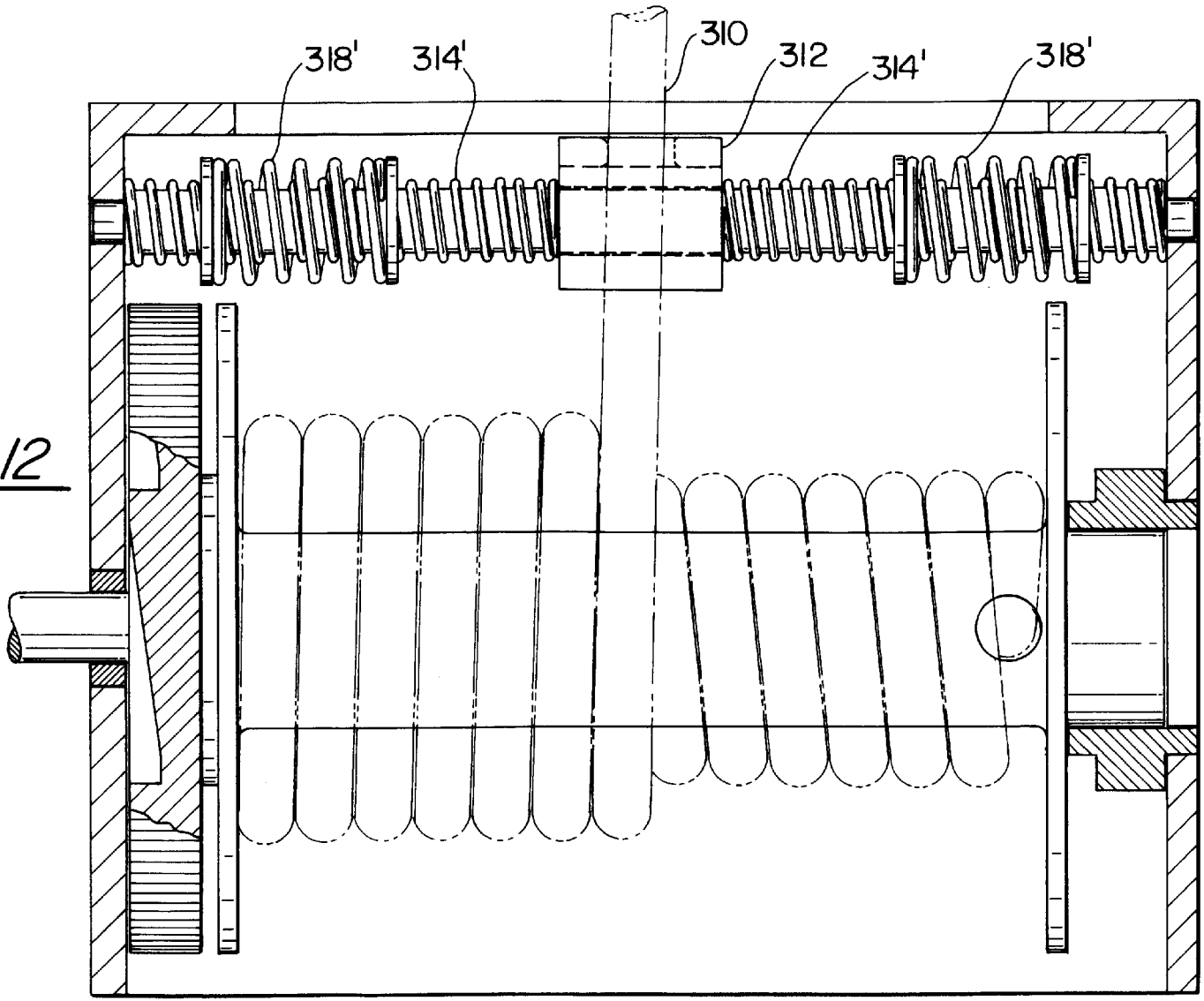
FIG. 12 is top view of the line positioner and spool having a double line wrap.

As shown in FIG. 12, line 310 having formed a single wrap over the length of the spindle, is illustrating wrapping back over the spindle and previously laid single wrap. Secondary springs 318 and 318' are relaxed and primary springs 314 and 314' provide pressure to maintain the line positioner 312 in a central location with sufficient allowance so that the line 310 will follow that natural curve of the winding which results in compression of spring 314' as rotation occurs.

It is to be understood that while I have illustrated and described certain forms of my invention, it is not to be limited to the specific forms herein described and shown. It will be apparent to those skilled in the art that various changes may be made without departing from the scope of the invention and the invention is not to be considered limited to what is shown in the drawings and described in the specification.

What is claimed is:

1. A docking apparatus for temporarily securing a vessel to a fixed object, said docking apparatus comprising:

at least one rotatable spool permanently secured to said vessel, said spool having opposing face plates with a spindle placed therebetween and formed integral thereto, said spindle and said opposing face plates having a smooth surface;

a docking line having a proximal end coupled to said spindle and a distal end available for coupling to said fixed object;

a means for weighting said distal end of said docking line;

means for directional alignment of said docking line to said spool, said docking line rotatably secured to said spindle when placed in a stored position;

a hydraulic system for providing rotational movement to said spool, said hydraulic system including an hydraulic pump having a fluid reservoir, said pump having a pressure line coupled to said spool providing rotation of said spool and a return line to said reservoir for recycling of said fluid; and a switching valve for providing rotation directional control of said spool;

control means remotely positioned from said hydraulic system for controlling rotational speed of said rotatable spool;

means for locking said rotatable spool in a fixed position, said means for locking said spool is a spring loaded hydraulic release cylinder, said release cylinder engaging a portion of said rotatable spool;

wherein said distal end of said docking line may be free wheeled from said spool for coupling to said fixed object whereby said docking line is returned to said rotatable spool at a speed dependent upon said hydraulic system providing directional rotation of said rotatable spool allowing vessel movement at a rate controllable by an operator of said vessel.

2. The docking apparatus according to claim 1 wherein said rotatable spool includes a means for positioning of said docking line.

3. The docking apparatus according to claim 1 wherein said docking apparatus includes a housing enclosing said spool, said housing having an aperture through which the distal end of said docking line extends;

said docking line includes an end cover means disposed on said distal end, said end cover sized to seal said aperture when said docking line is positioned around said spool.

4. The docking apparatus according to claim 3 wherein said end cover is formed from a rubber composite having a hand grip formed therein.

5. The docking apparatus according to claim 1 wherein said control means is further defined as a remotely located switch for operation of solenoid valves allowing directional control of said docking line.

6. The docking apparatus according to claim 1 wherein said vessel has a bow, a stern, a port side and a starboard side; wherein said retrieval device is mounted to said port side of said vessel.

7. The docking apparatus according to claim 6 wherein said retrieval device is mounted to said starboard side of said vessel.

8. The docking apparatus according to claim 6 wherein said retrieval device is mounted to said bow and said stern of said vessel.

9. The docking apparatus according to claim 1 wherein said means for directional alignment of said docking line to said spool is further defined as two spaced apart support rod having primary springs located on either side of a slotted line alignment bracket and secondary springs placed over said primary springs, said primary springs having a first biasing strength and said secondary springs having a second biasing strength.

10. The docking apparatus according to claim 9 wherein said first biasing strength is less than said second biasing strength.

11. A docking apparatus for temporarily securing a vessel to a fixed object, said docking apparatus comprising:

at least one rotatable spool permanently secured to said vessel, said spool having opposing face plates with a spindle placed therebetween and formed intregal thereto, said spindle and said said opposing face plates having a smooth surface;

a docking line having a proximal end coupled to said spindle and a distal end available for coupling to said fixed object;

a means for weighing said distal end of said docking line;

means for directional alignment of said docking line to said spool including two spaced apart support rods having primary springs located on either side of a slotted line alignment bracket and secondary springs placed over said primary springs, said primary springs having a first biasing strength and said secondary springs having a second biasing strength, said docking line rotatably secured to said spindle when placed in a stored position;

an electric motor secured to said spool and electrically coupled to a battery, said electric motor including a relay means for providing rotational directional control of said spool;

control means remotely positioned from said electric motor for controlling rotational speed of said rotatable spool;

means for locking said rotatable spool in a fixed position;

wherein said distal end of said docking line may be free wheeled from said spool for coupling to said fixed object whereby said docking line is returned to said rotatable spool at a speed dependent upon said electric motor providing directional rotation of said rotatable spool allowing vessel movement at a rate controllable by an operator of said vessel.

12. The docking apparatus according to claim 11 wherein said rotatable spool includes a means for positioning of said docking line.

13. The docking apparatus according to claim 11 wherein said docking apparatus includes a housing enclosing said spool, said housing having an aperture through which said distal end of said docking line extends, said docking line includes an end cover means disposed on said distal end, said end cover sized to seal said aperture when said docking line is positioned around said spool.

14. The docking apparatus according to claim 13 wherein said end cover is formed from a rubber composite having a hand grip formed therein.

15. The docking apparatus according to claim 11 wherein said control means is further defined as a remotely mounted switch for operation of solenoid valves allowing directional control of said docking line.

16. The docking apparatus according to claim 11 wherein said vessel has a bow, a stern, a port side and a starboard side; wherein said retrieval device is mounted to said port side of said vessel.

17. The docking apparatus according to claim 16 wherein said retrieval device is mounted to said starboard side of said vessel.

18. The docking apparatus according to claim 16 wherein said retrieval device is mounted to said bow and said stern of said vessel.

19. The docking apparatus according to claim 11 wherein said first biasing strength is less than said second biasing strength.

20. The docking apparatus according to claim 11 wherein said means for locking said spool is a spring loaded electric release cylinder, said release cylinder engaging a portion of said rotatable spool.

* * * * *